US005321757A

United States Patent [19]

Woodfill, Jr.

[11] Patent Number: 5,321,757

[45] Date of Patent: Jun. 14, 1994

[54] HEARING AID AND METHOD FOR PREPARING SAME

[75] Inventor: Ernest L. Woodfill, Jr., Columbia Heights, Minn.

[73] Assignee: Minnesota Mining and Manufacturing Company, St. Paul, Minn.

[21] Appl. No.: 887,592

[22] Filed: May 20, 1992

Related U.S. Application Data

[63] Continuation of Ser. No. 569,955, Aug. 20, 1990, abandoned.

[51] Int. Cl.[5] ..... H04R 25/00

[52] U.S. Cl. ..... 381/68; 381/68.6; 381/69

[58] Field of Search ..... 381/68.6, 68, 69, 68.7, 381/69.1; 181/135, 130; 264/222, DIG. 30

[56] References Cited

U.S. PATENT DOCUMENTS

| | | | |
|---|---|---|---|
| Re. 33,017 | 8/1889 | Bellafiore | 381/68.6 |
| 2,787,670 | 2/1953 | Rowland | 179/107 |
| 3,097,059 | 7/1963 | Hoffman | 18/55.05 |
| 3,440,314 | 4/1969 | Frisch | 264/222 |
| 3,513,269 | 1/1967 | Wilson | 179/107 |
| 3,527,901 | 3/1967 | Geib | 179/107 |
| 3,890,474 | 6/1975 | Glicksberg | 179/107 |
| 4,091,067 | 5/1978 | Kramer et al. | 264/222 |
| 4,569,812 | 8/1986 | Werwath et al. | 264/222 |
| 4,712,245 | 12/1987 | Lyregaard | 381/68.6 |
| 4,729,451 | 3/1988 | Brander et al. | 181/130 |
| 4,739,512 | 4/1988 | Hartl et al. | 381/68.6 |
| 4,800,636 | 1/1989 | Topholm | 29/169.5 |
| 4,834,927 | 5/1989 | Birkholz et al. | 264/134 |
| 4,860,362 | 8/1989 | Tweedle | 381/69 |
| 4,870,688 | 9/1989 | Voroba et al. | 381/60 |
| 4,871,502 | 10/1989 | Lebisch et al. | 264/222 |
| 4,962,537 | 10/1990 | Basel et al. | 301/68.6 |
| 5,031,219 | 7/1991 | Ward et al. | 381/68.6 |

FOREIGN PATENT DOCUMENTS

| | | | |
|---|---|---|---|
| 0361594 | 9/1989 | European Pat. Off. | H04R 25/02 |
| 969734 | 5/1963 | United Kingdom . | |
| 1586432 | 3/1978 | United Kingdom | B29D 31/00 |
| 2203379 | 10/1988 | United Kingdom | B29C 39/02 |

OTHER PUBLICATIONS

Voroba, B., "A Tool for the Optimization of Hearing Aid Fittings", Hearing Instruments, vol. 35, No. 1 (1984) pp. 12–16.

PCT Publication WO88/03740 (Ward) 19 May 1988.

*Primary Examiner*—James L. Dwyer
*Assistant Examiner*—Jason Chan
*Attorney, Agent, or Firm*—Gary L. Griswold; Walter N. Kirn; John H. Hornickel

[57] ABSTRACT

A method is disclosed for forming a hearing aid by the in situ molding of a room temperature curing material about hearing aid components. The in situ molding of the custom hearing aid provides an acoustical and comfort fit and minimizes processing involving multiple impression and casting procedures.

16 Claims, 1 Drawing Sheet

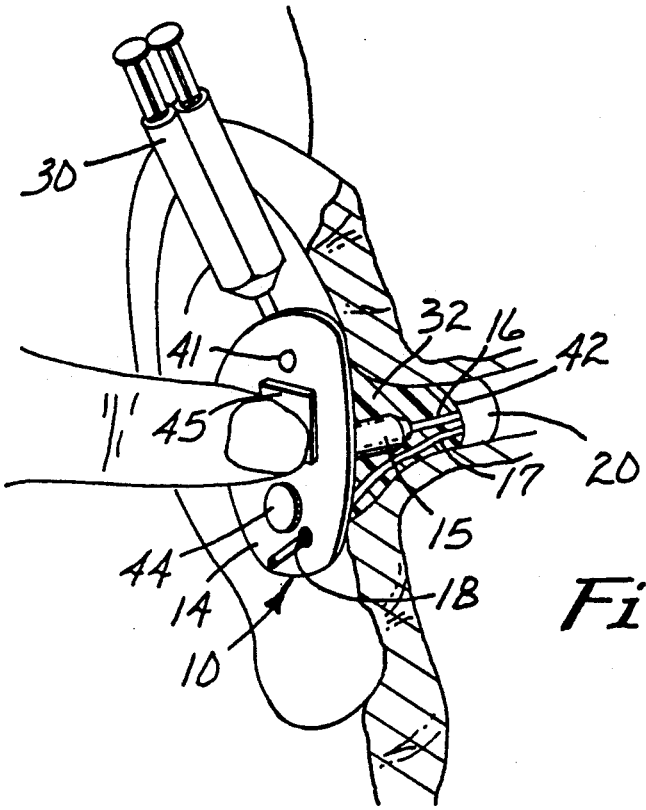
Fig. 1
Fig. 2
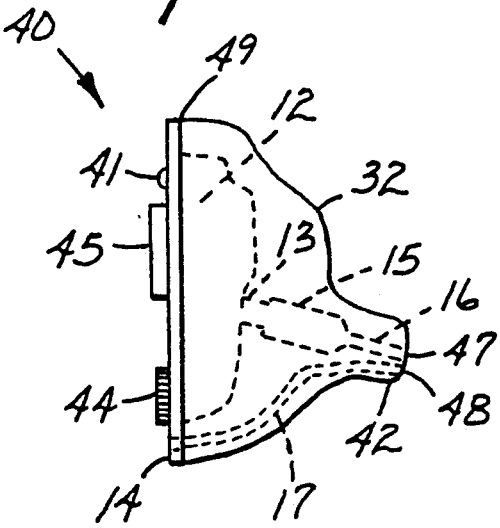
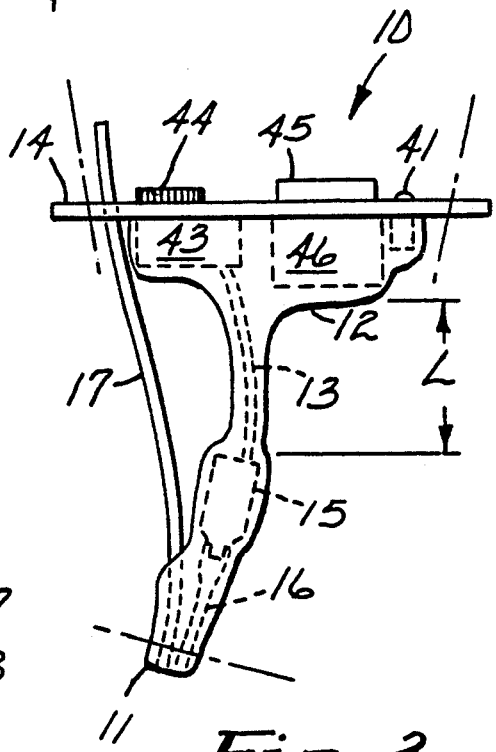
Fig. 3

HEARING AID AND METHOD FOR PREPARING SAME

This is a continuation of application Ser. No. 07/569,555 filed Aug. 20, 1990, now abandoned.

FIELD OF THE INVENTION

This invention relates to a hearing aid having an electronic components core and a room temperature curing impression material earmold, and a method of making a hearing aid by the in situ molding of the hearing aid in an external auditory canal.

BACKGROUND OF THE INVENTION

In recent years, hearing aids for hearing-impaired individuals and others who may desire amplified sound to their ear have enjoyed the advance of electronics.

In the past, hearing aids had an ear receiver connected by wires to the sound correction units either behind the ear (BTE) or placed in a pocket or on a belt of the individual. More recently, electronics has become sufficiently miniaturized to permit the entire hearing aid to reside in the ear.

Because the pinna of the ear is the natural sound gathering anatomy for human hearing, the presence of a receiver, amplifier, and transmitter within the pinna and external auditory canal has proven to be an acoustic advantage for the individual. Further, confinement of the ITE hearing aid within the pinna has been viewed as a cosmetic improvement over prior hearing aid constructions.

ITE hearing aids have been produced two ways: (1) a customized fitting to the individual's pinna and/or external auditory canal and (2) a series of stock modular canal aids designed to approximate the pinna and/or external auditory canal of most individuals.

A custom ITE hearing aid is conventionally made using a series of elaborate casting and recasting steps involving more than one visit by the individual to the hearing aid dispenser. A positive ear impression is made of the individual's pinna and external auditory canal which is used to create a negative impression at the hearing aid manufacturer, typically a remote location from the hearing aid dispenser. The negative impression is used to cast a positive impression of the pinna and external auditory canal which is subjected to grinding and polishing steps and assembly of electronic components therein. The assembled ITE hearing aid is returned to the hearing aid dispenser for fitting in the individual's ear. It is common for the fitting process to require several iterations to assure a comfortable fit for the individual. The acoustic fit of the rigid ITE hearing aid through all these casting-fitting operations becomes increasingly inaccurate. More than one individual having undergone the impression and fitting process has not used the hearing aid because of acoustic or structural discomfort.

Stock ITE hearing aids may minimize the number of visits by the individual to the hearing aid dispenser but do not provide an ITE hearing aid which is unique to the individual's pinna and external auditory canal. Thus, both acoustic and comfort fit may suffer.

Others have tried to provide a method for forming hearing aids.

For example, U.S. Pat. No. 3,097,059 (Hoffman) discloses a method for forming in the pinna and external auditory canal a freely moldable mass of soft malleable acrylic resin having placed in its flat external surface a conventional receiver ring for a pocket, hip, or BTE hearing aid. U.S. Pat. No. 3,440,314 (Frisch) also discloses a method of forming a custom-fitted ear plug for a BTE hearing aid using a room temperature curing silicone rubber formed around a tube placed into the external auditory canal.

Methods of forming an ITE hearing aid are disclosed in U.S. Pat. No. 4,091,067 (Kramer et al.) and Voroba, "Hearing Instruments", Vol. 35, No. 1, 1984, pages 12–16. In Kramer et al., a silicone polymer is molded around a small diameter coring form and then pressed into the ear to form a body which conforms to the shape of the pinna and external auditory canal. Thereafter, an apertured component is embedded in the outer surface of the body and, after the composition is cured, the coring form is removed to leave a sound transmitting passageway extending through the receiver and between the apertured component and the ear canal. One embodiment discloses the apertured component to be a miniature speaker acoustically coupled with the sound transmitting passageway. Otherwise, the communications speaker is inserted into the apertured component.

The Voroba article describes the fabrication of a shell using a soft plastic material injected into the ear canal which is molded while an appropriately sized mandrel is pressed into the plastic material. The cavity formed by the mandrel may be fitted with a face plate which snap fits into the cavity and over the distal surface of the shell formed.

With the development of miniature electronic circuits and miniature electronic microphone and receiver transducers, it has become possible to minimize the number of operations needed to determine proper audiology to be used in a hearing aid. For example, Minnesota Mining and Manufacturing Company (3M) markets a hearing aid under the brand "Memory Mate" which uses electronics in the hearing aid to refine through electronic programming the hearing improvement needed for an individual.

It would be preferable for hearing aid dispensers, audiologists, and patients for the currently cumbersome process of preparing a custom fitted hearing aid to be streamlined. A complete, custom hearing aid which could be fitted in one office visit would maximize the convenience of users requiring hearing aids, would compress the time and cost to complete the formation of the hearing aid earmold for acoustical and comfortable fit, and allow completion of the sales transaction in a single visit to the merchant.

Notwithstanding these developments, more recently, methods of making ITE hearing aids have refined on, positive casting custom process.

For example, U.S. Re. No. 33,017 (U.S. Pat. No. 4,617,429, Bellafiore) uses a dentist's material for making the positive impression, a dental material for making a negative cast, silicone material to cover and preset electronic components which are placed in the negative cavity before filling with acrylic material to mold the final ITE hearing aid.

U.S. Pat. No. 4,834,927 (Birkholz et al.) generates a cavity for electric components to be assembled at a manufacturer by providing a die having an overshell and cap which is inserted into the ear when making the positive impression. The removal of this die, overshell, cap combination provides a negative cavity of a constant dimension into which an electronic ITE module may be seated firmly and acoustically tight.

On the other hand, U.S. Pat. No. 4,871,502 (LeBisch et al.) discloses an otoplastic manufactured directly in the ear by using a die inside a deformable envelope in the ear and the supplying of flowing otoplastic material between the die and the envelope. After the otoplastic has set, die and the envelope are removed and a module of a hearing aid is inserted into the cavity created by the die.

U.S. Pat. No. 4,860,362 (Tweedle) discloses an open end ITE hearing aid shell with a non planar face plate. U.S. Pat. No. 4,870,688 (Voroba et al.) discloses a prefabricated ear shell assembly having a standard fabrication into which electronic components snap fit. The prefabricated shell assembly is a hollow rigid shell with a soft exterior having a cavity into which a variety of electronic components may be tested by the individual at the time of fitting. UK Patent Application 2 203 379 (Painter) discloses inserting a flexible walled membrane into the ear to conform to its surfaces and to serve as the envelope for inserting plastics material to mold to the shape of the ear surfaces. After cure and removal from the ear, the membrane is discarded and the earmold, preferably set in place with a central void, is fitted with an electronics module into the void.

One has disclosed a pre-fabricated hearing aid which may be attempted to be molded in situ in an exterior auditory canal. U.S. Pat. No. 4,712,245 (Lyregaard) discloses the use of a thin elastic layer attached as an envelope around a non-adjustable hearing aid case and sealed at both ends of the case. The space between the envelope and the case is filled with two-component curing ear impression material separated by a thin partitioning wall which can be ruptured under hand pressure to initiate curing. After the appropriate electronics is determined, a stock hearing device with impression material in the envelope is selected. The fitter ruptures the impression material partitioning wall and inserts the device into the ear canal for molding and curing of the impression material within the envelope.

But kneading of the two-part impression material within a confining space between the case and the envelope may not provide an appropriate impression of the pinna and external auditory canal, for Lyregaard emphasizes the ease by which a first fitting may be discarded and replaced by a subsequent fitting(s) using the same process with new component(s). Lyregaard limits the amount of impression material to conform to the convoluted pinna and external auditory canal to that amount contained between the case containing inflexible electronics components and the envelope sealed to the case in order to rely on a stock of modules of electronic components to fit his method of assembly.

SUMMARY OF THE INVENTION

The present invention provides a method for the in situ formation of a custom contoured hearing aid. The method comprises inserting into an external auditory canal at least a flexible distal end of an electronics subassembly which is conformable and adjustable to contours of the external auditory canal to form an area between the electronic subassembly and meatus tissue of the external auditory canal; injecting a room temperature curing earmold material into the area to conform to the contours of the external auditory canal; and allowing the earmold material to cure in the area to form the custom contoured hearing aid.

The present invention further provides a custom contoured hearing aid formed by the method of in situ formation just described. The present invention further provides a custom contoured hearing aid of a room temperature curing silicone polymeric earmold cured about at least a portion of a programmable electronics subassembly in an external auditory canal of an ear.

The present invention also optionally provides a method of placing the distal end of the electronics subassembly in a mold material block to protect the tympanic membrane in the external auditory canal and to minimize contact of the electronics subassembly with the meatus tissue forming the external auditory canal.

For purposes of describing the present invention, "external auditory canal" means the area within the pinna of an ear and extending inward to the tympanic membrane of the ear, or any portion thereof in which a hearing aid may be formed in situ.

It is a feature of the present invention that the complexity of hearing aid construction is minimized by forming a custom hearing aid in situ using a room temperature curing impression material cured about an electronics subassembly conformable and adjustable to the geometry of the external auditory canal.

It is a feature of the present invention that the electronic subassembly is inserted into the external auditory canal at the time of hearing aid construction.

It is an advantage of the present invention that the custom hearing aid, constructed in situ using room temperature curing impression material, conforms to the unique contours of the external auditory canal and cures to provide an earmold providing an acoustic and comfort fit acceptable to the individual user.

It is an advantage of the present invention that the acoustic and comfort fit of the in situ formed hearing aid can be easily optimized by trimming critical locations of the earmold and adjusting performance of the electronics subassembly.

A more detailed understanding of the scope of the present invention and its embodiments follows.

BRIEF DESCRIPTION OF THE DRAWING

FIG. 1 is an illustrative view of the construction of the custom ITE hearing aid; and FIG. 2 is a side view of the constructed ITE hearing aid.

FIG. 3 is a side view of the conformable electronics subassembly having a flexible distal end.

EMBODIMENTS OF THE INVENTION

Method of Hearing Aid Construction

The electronics subassembly 10 may be selected according to the external auditory needs of the individual patient based on audiogram testing. As seen in FIGS. 1 and 3, the electronics subassembly 10 has extending toward a distal end 11 from electronics core 12 a receiver 15. The receiver 15 is connected to core 12 by very flexible wires 13 and has a flexible sound transmission tube 16 extending therefrom to the distal end 11. A flexible and adjustable vent tube 17 also extends from adjacent the electronics core 12 through face plate 14 at aperture 18 to distal end 11.

At least the distal end 11 of electronics subassembly 10, including flexible wires 13, receiver 15, flexible sound transmission tube 16 and flexible vent tube 17 extending therefrom, is inserted into the external auditory canal. Preferably with a core 12 smaller than the pinna of an ear, the entire electronics subassembly 10 may be inserted into the external auditory canal.

The flexibility of wires 13, tube 16, and tube 17 allows the subassembly 10 to conform to the unique contours of an external auditory canal of an individual, which minimizes contact with the meatus tissue of the external auditory canal.

Preferably, prior to insertion of the distal end 11 of subassembly 10 into the ear, a mold block 20 may be placed in contact with a tympanic membrane to protect this delicate portion of the ear from contact with tubes 16 and 17 and provide spacing for the acoustical path of sound within the external auditory canal. The mold block 20 is a soft material, typically cotton or a customized product such as "ODOBLOCK TM" sponge commercially available from Earmold Design Inc. of Minneapolis, Minn.

A mold material injection system 30, typically a mixing device used for dispensing ear or dental impression material, is placed adjacent to the pinna and external auditory canal beneath the face plate 14 and into the external auditory canal of the individual. Earmold material 32 is mixed and injected by the injection system 30 into the external auditory canal between the meatus tissue of the external auditory canal and the electronics subassembly 10. Alternately, a second aperture (not shown) in the face plate 14 is made and used as the delivery port for earmold material 32 injected into the external auditory canal.

The earmold material 32 flows and fills the area between meatus tissue of the external auditory canal and the electronics subassembly 10 beneath the face plate 14, surrounding the wires 13, the receiver 15, the flexible sound transmission tube 16, and the flexible vent tube 17. Because the tubes 16 and 17 are flexible and are preferably in contact with block 20, wires 13, receiver 15 and tubes 16 and 17 minimize contact with the meatus tissue of the external auditory canal.

Preferably, adjusting the length of the vent tube 17 in the external auditory canal and causing flexible wires 13 to bend circuitously in the external auditory canal as required minimizes contact with the meatus tissue of the external auditory canal. Thus, the earmold material surrounds wires 13, receiver 15 and tubes 16 and 17 and further conforms the electronic subassembly to the unique contours of external auditory canal with sufficient earmold material to accommodate each unique external auditory canal likely to be fitted for a hearing aid.

The earmold material 32 cures, typically at room temperature or body temperature of the individual. After the earmold material 32 has sufficiently cured for about ten minutes, about the same length of time as it would take to make an ear impression, the custom conforming hearing aid 40 is removed from the ear and the mold material block 20 is removed.

Referring to FIG. 2, the completed custom conforming hearing aid 40 may be removed from the ear for final processing, if necessary. The face plate 14 is trimmed to the size of the earmold 32 and the earmold 32 is trimmed or abraded to remove flash to improve the aesthetic appearance of the custom conforming hearing aid 40. A fine grit abrasive wheel or grinding tip may be effective for use on both the inflexible plastic material of the face plate 14 and the flexible earmold 32.

Further, after the hearing aid 40 is removed from the ear, the canal portion 42 of the molded hearing aid 40 may be trimmed to a carefully selected length with a sharp blade such as a knife to provide clear opening 47 for flexible sound transmission tube 16 and a clear opening 48 for flexible and adjustable vent tube 17. Also, the vent tube 17 may have to be trimmed at aperture 18 on the external surface of face plate 14 with a sharp blade.

The amount of the canal portion 42 of hearing aid 40 which may be removed is related to the amount of hearing loss to be adjusted. The proper length of canal portion 42 is determined either experimentally based on successive real ear performance measurements on the individual or by a predetermined measurement provided by experience or manufacturer recommendations.

The electronics subassembly 10 may be also adjusted at this final fitting process to optimize the recovery of hearing loss. The subassembly 10 preferably has programmable capabilities to perform the optimization process. Thus, the hearing aid preferably is customized in conforming and flexible fit in the pinna and external auditory canal and customized in the acoustic correction for hearing loss.

ELECTRONICS SUBASSEMBLY

Referring to FIG. 3, the electronic core 12 of an electronic subassembly 10 useful for a hearing aid 40 formed by the present invention may be secured to faceplate 14 with adhesive, e.g., a silicone adhesive. The core comprises a microphone 41, electronic amplifier and filter circuitry 43, at least one control switch 44, a battery compartment door 45, and alternately, programming interface or a battery supply 46. The switches 44 and door 45 project from the faceplate 14. The receiver 15 is physically and electrically connected to core 12 by very flexible electrical wires 13. On the distal side of receiver 15 toward distal end 11 is the flexible sound transmission tube 16 which acoustically transmits sound from receiver 15 to the external auditory canal. The length (L) of the attachment wires 13 is about 1 cm. to about 3 cm. to allow flexible bending and positioning of the receiver 15, tube 16 and vent tube 17 to minimize contact with the meatus tissue of the external auditory canal before injecting the mold material 32 into the area of the external auditory canal not occupied by the electronic subassembly 10. In the process of positioning of the receiver 15 and the remainder of the electronics subassembly 10, the distance (L) between the receiver 15 and core 10 will be reduced, and possibly eliminated, by the bending of flexible wires 13 within the external auditory canal. The amount of distance (L) reduced depends on each unique size, length and shape of an external auditory canal of an ear.

The presently preferred electronics subassembly 10 is the electronics subassembly of the "Memory Mate TM" branded hearing aid made and sold by 3M, St. Paul, Minn. The electronics and operation of that hearing aid is described in U.S. Pat. No. 4,425,481 (Mansgold et al.), the disclosure of which is incorporated by reference. This subassembly is preferred because the electronics may be programmed according to the particular audiological requirements of the individual after an audiogram has been recorded and analyzed by the hearing health care professional providing the fitting of the hearing aid 40. The programmability of the subassembly 10 avoids the present need in the art to have several electronic modules available for insertion into cavities created by prior hearing aid impression formation systems. One programmable electronics subassembly 10 and one in situ molding of a custom hearing aid 40 would suffice to provide a single visit fitting of the hearing aid 40 for an individual.

Optionally, to protect the entire electronics subassembly 10, a flexible coating 49 of protective material such as silicone adhesive commercially available from Dow Chemical Co. under the brand "Silicone Adhesive A" may be applied to the surfaces of the core 12 beneath the faceplate 14, the wires 13, the receiver 15, sound transmission tube 16, and vent tube 17, during manufacture of the subassembly 10. The flexible coating 49 protects these items 10, 13, 15, 16, and 17 during shipping, handling, and hearing aid construction. The coating also facilitates uniform adhesion of the mold material 32 to these items.

A vent between the external auditory canal and the open air is preferred for proper functioning of hearing aid 40. The vent tube 17 provides a sound venting path from near the tympanic membrane to the open air and prevents unpleasant pressures, occluded sensations in the external auditory canal, and distortion of the acoustical performance of the receiver 15. To provide this atmospheric communication, the vent tube 17 is positioned in association with the electronics subassembly 10. The distal end of tube 17 is positioned near the open end of the receiver tube at distal end 11, secured in parallel with the sound transmission tube 16, and trimmed as necessary to provide an opening 48 after mold material 32 cures.

The vent tube 17 extends through aperture 18 in the face plate 14 and is free to move with respect to the face plate 14. As the wires 13, receiver 15 and tubes 16 and 17 are positioned in the external auditory canal to minimize contact with the meatus tissue thereof, any excess length of vent tube 17 is withdrawn from the external auditory canal through face plate 14 to prevent kinking of tube 17 and to provide an open channel from the tympanic membrane to the atmosphere.

EARMOLD MATERIAL

Room temperature curing dental and ear impression materials which have good flow and dispensing properties from an injection system 30 are suitable as the earmold material 32 of the present invention. A two part room temperature curing silicone polymer is desired. The presently preferred earmold material 32 is 3M brand "Imprint TM" No. 9410H two part dental impression material which is commercially available from 3M, St. Paul, Minn. 3M brand "Imprint TM" No. 9410H dental impression material is preferred because it flows well from the injection system 30 into the external auditory canal, because it conforms to the area between electronic subassembly 10 and the meatus tissue of the external auditory canal, and because it adheres to the various items of electronics subassembly 10 with essentially no shrinkage.

The earmold material 32 is preferably injected into the external auditory canal utilizing 3M brand "Express TM" dispenser having a static mixing tip and a two part mixing cartridge containing the two part earmold material. The dispenser is commercially available as Item No. 7308 from the Dental Products Division of 3M, St. Paul, Minn. The static mixing cartridge and tip are described in U.S. Pat. No. 4,538,920, the disclosure of which is incorporated by reference. The dispenser, cartridge and static mixing tip provide thorough mixing during injection into the external auditory canal without messy handling, inaccurate measurement or incomplete mixing. Two part room temperature curing impression materials are mixed just prior to injection into the external auditory canal which assures proper cure into a canal portion 42 of hearing aid 40 conforming to the contoured surfaces of the external auditory canal.

Without being limited to the foregoing, the present invention is hereby claimed.

What is claimed is:

1. A method for the in situ formation of a custom contoured hearing aid, comprising:

inserting into an external auditory canal at least a flexible distal end and an electronics subassembly which has an adjustable length and is conformable and adjustable to contours of the external auditory canal to form an area between the electronics subassembly in the external auditory canal and meatus tissue of the external auditory canal, the electronics subassembly comprising an electronics core and the flexible distal end containing a receiver physically and electrically connected to the core by at least one flexible wire having a length which establishes a distance between the core and the receiver; and the flexible distal end including a flexible and adjustable vent tube extending adjacent the electronics core;

adjusting the length of the electronics subassembly in the external auditory canal and the distance between the core and the receiver up to the length of said at least one flexible wire by adjusting the length of the vent tube in the external auditory canal and causing said at least one flexible wire to bend in the external auditory canal between the core and the receiver, to minimize contact of said at least a flexible distal end of the electronics subassembly with the meatus tissue of the external auditory canal;

injecting a room temperature curing earmold material into the area to conform to the contours of the external auditory canal; and allowing the earmold material to cure in the area to form the custom contoured hearing aid.

2. The method according to claim 1, wherein prior to said inserting step, the method further includes placing a mold material block in the external auditory canal to contact the flexible distal end.

3. The method according to claim 2, wherein said injecting step flows the earmold material into the area to surround the electronics subassembly before the earmold material cures.

4. The method according to claim 2, wherein the electronics subassembly further comprises a flexible sound transmission tube extending from the receiver, wherein the step of adjusting length of the vent tube and the flexibility of wire, vent tube, and sound transmission tube allows the subassembly to conform to unique contours of the external auditory canal to minimize contact of the electronics subassembly with the meatus tissue of the external auditory canal.

5. The method according to claim 4, further comprising after curing the steps of removing the hearing aid from the ear, removing the mold material block, and trimming the hearing aid adjacent the distal end of the electronics subassembly to open the vent tube and the sound transmission tube at the distal end.

6. The method according to claim 5, further comprising after said trimming step the step of adjusting electronics performance of the electronic subassembly.

7. The method according to claim 6, wherein said adjusting step includes programming electronic components in the electronics subassembly.

8. The method according to claim 1, further comprising before said inserting step, the step of coating the electronics subassembly with a protective coating.

9. A custom contoured hearing aid formed in situ in an external auditory canal of an ear by the steps comprising:

placing into an external auditory canal at least a flexible distal end and an electronics subassembly conformable and adjustable to the external auditory canal of the ear to form an area between the electronics subassembly in the external auditory canal and meatus tissue of the external auditory canal, the electronics subassembly having an adjustable length and comprising an electronics core and the flexible distal end containing a receiver physically and electrically connected to the core by at least one flexible wire having a length which establishes a distance between the core and the receiver; and the flexible distal end including a flexible and adjustable vent tube extending adjacent the electronics core;

adjusting the length of the electronics subassembly in the external auditory canal and the distance between the core and the receiver up to the length of said at least one flexible wire by adjusting the length of the vent tube in the external auditory canal and causing said at least one flexible wire to bend in the external auditory canal between the core and the receiver in the external auditory canal, to minimize contact of said at least a flexible distal end of the electronics subassembly with the meatus tissue of the external auditory canal;

injecting a room temperature curing earmold material into the area to conform to contours of the external auditory canal; and allowing the earmold material to cure in the area to form the custom contoured hearing aid.

10. The hearing aid according to claim 9, wherein during injecting the room temperature curing earmold material flows into the area and surrounds the electronics subassembly before curing.

11. The hearing aid according to claim 9, wherein the distal end of the electronics subassembly has a flexible sound transmission tube extending from the receiver, wherein the flexibility of wire, vent tube, and sound transmission tube allows the subassembly to conform to unique contours of the external auditory canal to minimize contact of the electronics subassembly with the meatus tissue of the external auditory canal.

12. The hearing aid according to claim 9, wherein the earmold material is trimmable at the distal end of the electronics subassembly.

13. The hearing aid according to claim 9, further comprising a protective coating over the electronics subassembly.

14. The hearing aid according to claim 9, wherein the electronics subassembly has an adjustable electronic operation.

15. The hearing aid according to claim 14, wherein said adjustable electronic operation is programmable.

16. A custom contoured hearing aid, comprising: a room temperature curing silicone polymeric earmold cured about at least a portion of a programmable electronics subassembly having an adjustable length and conformable and adjustable in an external auditory canal of an ear, said programmable electronics subassembly comprising an electronics core and a flexible distal end containing a receiver physically and electrically connected to the core by at least one flexible wire having a length which establishes a distance between the core and the receiver, and the flexible distal end including a flexible and adjustable vent tube extending adjacent the electronics core;

said programmable electronics subassembly adjustable in length and the distance between the core and the receiver adjustable up to the length of said at least one flexible wire by adjusting the length of the vent tube in the external auditory canal and causing said at least one flexible wire to bend in the external auditory canal, to minimize contact of the electronics subassembly with meatus tissue of the external auditory canal prior to earmold curing.

* * * * *

UNITED STATES PATENT AND TRADEMARK OFFICE

CERTIFICATE OF CORRECTION

PATENT NO.: 5,321,757

DATED: June 14, 1994

INVENTOR(S): Woodfill, Jr.

It is certified that error appears in the above-identified patent and that said Letters Patent is hereby corrected as shown below:

At column 2, lines 52-53, "refined on positive casting custom process." should read -- refined the technique of making a positive impression, negative impression, postive casting custom process --.

At column 8, line 9, "and" should read -- of --.

Signed and Sealed this

Fifth Day of December, 1995

*Attest:*

Bruce Lehman

BRUCE LEHMAN

*Attesting Officer*

*Commissioner of Patents and Trademarks*